US007458423B2

(12) United States Patent
Vercaemer et al.

(10) Patent No.: US 7,458,423 B2
(45) Date of Patent: Dec. 2, 2008

(54) METHOD OF SEALING AN ANNULUS SURROUNDING A SLOTTED LINER

(75) Inventors: Claude Joseph Vercaemer, Paris (FR); Hubertus V. Thomeer, Houston, TX (US); Charles Woodburn, Marnes la Coquette (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 128 days.

(21) Appl. No.: 11/277,869

(22) Filed: Mar. 29, 2006

(65) Prior Publication Data

US 2007/0227733 A1 Oct. 4, 2007

(51) Int. Cl.
*E21B 33/13* (2006.01)

(52) U.S. Cl. ..... 166/292; 166/227; 166/387

(58) Field of Classification Search ..... 166/191, 166/205, 292–294, 227, 68, 105, 107, 55, 166/297, 298, 305.1, 308.1–308.5, 387; 175/314, 175/424
See application file for complete search history.

(56) References Cited

U.S. PATENT DOCUMENTS 3,145,773 A * 8/1964 Jorda et al. ..... 166/290
4,235,291 A * 11/1980 Messenger ..... 166/292
4,917,188 A * 4/1990 Fitzpatrick, Jr. ..... 166/295
5,103,911 A 4/1992 Heijnen
5,697,441 A 12/1997 Vercaemer
5,715,891 A 2/1998 Graham
6,286,598 B1 * 9/2001 van Petegem et al. ..... 166/297
6,318,465 B1 11/2001 Coon
6,354,375 B1 3/2002 Dewey
6,619,397 B2 9/2003 Coon
6,672,385 B2 * 1/2004 Kilaas et al. ..... 166/250.01
6,722,437 B2 * 4/2004 Vercaemer et al. ..... 166/308.1
6,732,806 B2 5/2004 Mauldin
6,848,505 B2 2/2005 Richard
7,013,979 B2 * 3/2006 Richard ..... 166/369
2002/0020527 A1 * 2/2002 Kilaas et al. ..... 166/250.01
2002/0096329 A1 7/2002 Coon
2003/0075333 A1 * 4/2003 Vercaemer et al. ..... 166/308
2003/0141059 A1 7/2003 Mauldin
2004/0144538 A1 7/2004 Richard
2004/0149431 A1 * 8/2004 Wylie et al. ..... 166/242.1
2004/0216877 A1 11/2004 Pedersen

* cited by examiner

*Primary Examiner*—Kenneth Thompson
(74) *Attorney, Agent, or Firm*—Rodney Warfford; David Cate; Jamie Castano

(57) ABSTRACT

A method of forming a seal circumferentially about a liner having pre-formed openings that is positioned in a wellbore includes the steps of running a perforating device and a seal applicator into the slotted liner, the seal applicator carrying a sealing fluid and a pumping mechanism, creating an aperture through the slotted liner at the region by activating the perforating device and pumping the sealing fluid from the seal applicator through the aperture and circumferentially about the liner to form a sealing plug in the annulus between the slotted liner and the wellbore.

4 Claims, 1 Drawing Sheet

METHOD OF SEALING AN ANNULUS SURROUNDING A SLOTTED LINER

FIELD OF THE INVENTION

The present invention relates in general to wellbore operations and more particularly to a method of isolating zones in a wellbore having a slotted liner.

BACKGROUND

In many well completions a casing is run into the well after it is drilled. Cement is then pumped into the annulus between the casing and the wellbore wall. The casing and cement is then perforated at the desired formation. By perforating the cemented and sealed casing, isolation of the desired zone is maintained.

A significant number of wells are completed with perforated liners without any cement to bond the liner to the wellbore. The annulus between the liner and the wall of the wellbore may then be left empty or packed with gravel. Although slotted liners serve a purpose, they do not provide zonal isolation and permit fluid to flow in the annulus along the length of the liner. Typically, at some point in the well's life, it is desired to provide zonal isolation in the well for selective treatment of a zone or to prevent encroachment of an undesired fluid.

Therefore, it is a desire to provide a system and method for placing a substantially circumferential seal about a perforated liner. It is a still further desire to provide a method of creating zonal isolation about a perforated liner that is cost effective.

SUMMARY OF THE INVENTION

Methods of forming a seal circumferentially about a liner having pre-formed openings that is positioned in a wellbore are provided. In one embodiment of the invention the method includes the steps of creating an aperture through the slotted liner at the region and pumping a sealing fluid through the aperture and circumferentially about the liner to form a sealing plug in the annulus between the slotted liner and the wellbore.

The aperture may be larger in size than the pre-formed openings. The aperture may be created by expanding one or more of the pre-formed openings or by creating a new aperture. The aperture may be created by a perforating gun or by drilling. The sealing fluid may be thixotropic in nature and/or a swellable material to facilitate placement through aperture while forming a suitable sealing plug where desired.

In some embodiments of the invention, the method may include conveying a sealing applicator into the liner. The seal applicator may include one or more reservoirs for carrying fluids such as, but not limited to the sealing fluid, spacing fluids, and triggering agents. The seal applicator may include a mechanism, such as a pressure reservoir or pump for energizing the sealing fluid for injection through the aperture.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
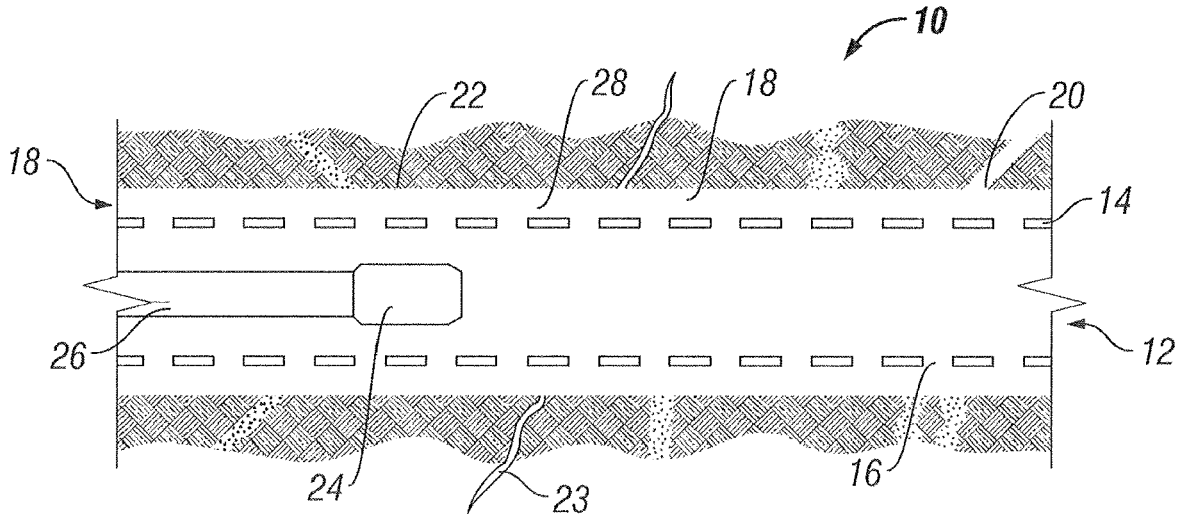
FIG. 1 is a schematic side view of an embodiment of the sealing method of the present invention.

Refer now to the drawings wherein depicted elements are not necessarily shown to scale and wherein like or similar elements are designated by the same reference numeral through the several views.

As used herein, the terms "up" and "down"; "upper" and "lower"; and other like terms indicating relative positions to a given point or element are utilized to more clearly describe some elements of the embodiments of the invention. Commonly, these terms relate to a reference point as the surface from which drilling operations are initiated as being the top point and the total depth of the well being the lowest point.

FIG. 1 is a schematic side view of an embodiment of the sealing method of the present invention, generally denoted by the numeral 10. A portion of a wellbore 12 is completed with a slotted liner 14. Slotted liner 14 includes a plurality of openings 16 formed along its length. As used herein, slotted liner 14 includes any liner or screen that has openings 16 formed therethrough prior to hanging the tubular in the wellbore. Examples of slotted liners 14 include slotted, perforated, or predrilled liners, or a screen or a pre-packed screen. The annulus 18 between slotted liner 14 and the wall 20 of wellbore 12 may be substantially empty or packed with sand or gravel.

It is desired to seal annulus 18 in a region 22. In the illustrated embodiment it is desired to seal annulus 18 due to water entry 23. In the first step of sealing method 10, a perforating apparatus 24 is positioned within slotted liner 14 proximate region 22 via conveyance 26. Perforating apparatus 24 may include, but is not limited to, perforating guns, drilling mechanisms or cutting mechanisms. Conveyance 26 may be tubing, a wireline or a slickline.

In the second step of method 10, perforating apparatus 24 is activated to create one or more apertures 28. Each aperture 28 is larger than the pre-existing openings 16. Aperture 28 may be a new opening formed through liner 14 or the expansion of an existing opening 16. The formation of one or more apertures 28 is critical for the placement of a sealing fluid sufficient to obtain a desired sealing plug circumferentially about liner 14.

Figure 2:
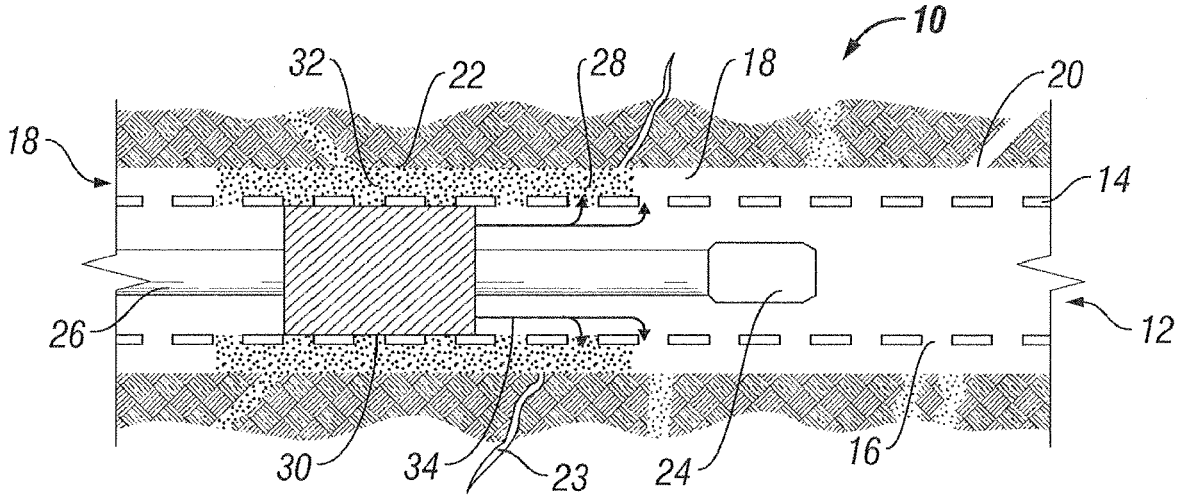
FIG. 2 is a further view of the sealing method illustrated in FIG. 1.

Referring now to FIG. 2, aperture 28 has been created through liner 14 for forming sealing plug 32 circumferentially about liner 14. To form sealing plug 32, sealing fluid 34 must be suitable for injecting through aperture 28 and for setting into a sealing plug within region 22. Thus, it is desired that sealing fluid 34 be thixotropic in nature so that it will set and become substantially "self-supporting" relatively quickly. It may further be desired for sealing fluid 34 to be a swellable material, so as to seal aperture 28 and openings 16 in region 22. The swellable property further facilitates sealing between wellbore 12 and liner 14. It may further be desired for sealing fluid 34 to have a sufficiently high gel strength so as to remain where placed, yet allow for a degree of gravity-induced flow to the lower portion of region 22, for example in horizontal wellbores. It is noted that sealing fluid 34 may include one or more of the desired properties. It is further noted, and will be recognized with the following description of the method, that sealing plug 32 may be formed in stages or by one or more sealing fluids 34. For example, a first sealing fluid 34 being primarily thixotropic in nature may be injected through aperture 28 into region 22 and then followed with a second swellable sealing fluid 34. The swellable sealing fluid 34 may be followed by a triggering agent. It may also be desired to inject spacing fluids, such as water or drilling fluid, after one or more sealing fluid injections.

Examples of suitable sealing fluids 34 include, without limitation, foamed cements; unfoamed cements containing smectic clays such as bentonite and attapulgite, unfoamed cements containing welan gum, aluminum and/or iron sulphate, and/or calcium sulfate as thixotropy agents, thermosetting polymers such as epoxy, vinylester, phenolic and polyester resins, and cross-linking polymer gels (possibly with an added thixotrope).

Swellable sealing fluid 34 swells from an unexpanded state to an expanded state when it comes into contact with or absorbs a triggering fluid. The selection of a triggering fluid depends on the selection of the swellable material, and vice versa, as well as the wellbore environment and operation. The triggering fluid may be present naturally in wellbore 12, present in the formation surrounding wellbore 12 and produced into the wellbore, or be injected into wellbore 12 and region 22, such as from the surface through tubulars or a downhole seal applicator 30.

Examples of suitable swellable sealing fluids 34 and their corresponding triggering fluids (listed in parenthetical) include, without limitation: ethylene-propylene-copolymer rubber (hydrocarbon oil); ethylene-propylene-diene terpolymer rubber (hydrocarbon oil); butyl rubber (hydrocarbon oil); haloginated butyl rubber (hydrocarbon oil); brominated butyl rubber (hydrocarbon oil); chlorinated butyl rubber (hydrocarbon oil); chlorinated polyethylene (hydrocarbon oil); starch-polyacrylate acid graft copolymer (water); polyvinyl alcohol cyclic acid anhydride graft copolymer (water); isobutylene maleic anhydride (water); acrylic acid type polymers (water); vinylacetate-acrylate copolymer (water); polyethylene oxide polymers (water); carboxymethyl celluclose type polymers (water); starch-polyacrylonitrile graft copolymers (water); highly swelling clay minerals, i.e. sodium bentonite, (water); styrene butadiene (hydrocarbon); ethylene propylene monomer rubber (hydrocarbon); natural rubber (hydrocarbon); ethylene propylene diene monomer rubber (hydrocarbon); ethylene vinyl acetate rubber (hydrocarbon); hydrogenised acrylonitrile-butadiene rubber (hydrocarbon); acrylonitrile butadiene rubber (hydrocarbon); isoprene rubber (hydrocarbon); chloroprene rubber (hydrocarbon); and polynorbornene (hydrocarbon).

In the embodiment illustrated in FIG. 2, conveyance 26 carries both seal applicator 30 and perforating apparatus 24 to facilitate a single trip into the well to create sealing plug 32 circumferentially about liner 14. By providing sealing fluid 34 via seal applicator 30 positioned downhole, the Theological requirements of fluid 34 are reduced and it allows for downhole mixing of two-part fluids or the like, for example, epoxy resins, which can set rapidly in region 22.

Seal applicator 30 may include one or more reservoirs carrying fluids and/or pumping means. For example, applicator 30 may include a reservoir carrying sealing fluid 34 and a reservoir carrying a triggering agent fluid for causing sealing fluid 34 to swell. In various embodiments, each reservoir may include a fluid for staging injections to form sealing plug 32. Sealing applicator 30 may further include aids, such as a source of heat or radiation, to trigger or aid the setting of sealing plug 32.

After aperture 28 is formed, conveyance 26 is run into liner 14 positioning seal applicator 30 proximate aperture 28 and region 22. Seal applicator 30 is actuated injecting sealing fluid 34, as shown by the arrows, through aperture 28 into annulus 18 circumferentially about liner 14 within region 22. In the described embodiment, sealing fluid 34 sets to become substantially self-supporting sealing plug 32. Further, sealing fluid 34 contacts a triggering agent, that is present in region 22 or injected via conveyance 26 or seal applicator 30, causing fluid 34 to swell further sealing aperture 28 and openings 16.

From the foregoing detailed description of specific embodiments of the invention, it should be apparent that a system and method for placing a annular seal about a slotted liner in a wellbore that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A method of placing a sealing plug about a region of a slotted liner having pre-formed openings that is positioned in a wellbore, the method comprising the steps of:

conveying a perforating device and a seal applicator into the slotted liner, the seal applicator including a reservoir holding a thixotropic and swellable sealing fluid and a pumping mechanism;

creating an aperture through the slotted liner; and pumping the sealing fluid through the aperture and circumferentially about the liner.

2. The method of claim 1, wherein the aperture created is larger than the size of the pre-formed openings.

3. The method of claim 1, wherein the aperture is created by drilling.

4. The method of claim 1, wherein the aperture is created by expanding at least one of the openings.

* * * * *